US010934072B2

(12) United States Patent
Lantz et al.

(10) Patent No.: US 10,934,072 B2
(45) Date of Patent: Mar. 2, 2021

(54) CHILD-RESISTANT SENIOR-FRIENDLY PACKAGING

(71) Applicant: Lantz Packaging, LLC, Arvada, CO (US)

(72) Inventors: Travis Lantz, Arvada, CO (US); Brandon Lantz, Arvada, CO (US)

(73) Assignee: Lantz Packaging, LLC, Erie, CO (US)

( * ) Notice: Subject to any disclaimer, the term of this patent is extended or adjusted under 35 U.S.C. 154(b) by 150 days.

(21) Appl. No.: 16/114,784

(22) Filed: Aug. 28, 2018

(65) Prior Publication Data

US 2019/0062023 A1 Feb. 28, 2019

Related U.S. Application Data

(60) Provisional application No. 62/595,720, filed on Dec. 7, 2017, provisional application No. 62/552,801, filed on Aug. 31, 2017.

(51) Int. Cl.

| | |
|---|---|
| ***B65D 77/04*** | (2006.01) |
| ***B65D 5/38*** | (2006.01) |
| ***B65D 75/32*** | (2006.01) |
| ***B65D 77/22*** | (2006.01) |

(52) U.S. Cl.

CPC ..... *B65D 77/0433* (2013.01); *B65D 5/38* (2013.01); *B65D 75/327* (2013.01); *B65D 77/22* (2013.01); *B65D 2215/02* (2013.01)

(58) Field of Classification Search

CPC ..... B65D 77/22; B65D 77/0433; B65D 5/38; B65D 2215/02; B65D 75/327

USPC ..... 206/1.5, 528, 538

See application file for complete search history.

(56) References Cited

U.S. PATENT DOCUMENTS

| | | | | |
|---|---|---|---|---|
| 1,253,489 A * | 1/1918 | Houghland | ..... | B65D 5/38 229/125.125 |
| 3,741,387 A * | 6/1973 | Whitecar | ..... | B65D 5/38 206/459.1 |
| 3,888,350 A * | 6/1975 | Horvath | ..... | B65D 43/12 206/531 |
| 4,076,117 A * | 2/1978 | Wisdom | ..... | A24F 27/00 206/106 |
| 4,401,210 A * | 8/1983 | Anjou | ..... | B65D 11/12 206/1.5 |

(Continued)

FOREIGN PATENT DOCUMENTS

WO 2010015638 A1 2/2010

*Primary Examiner* — Thomas M Wittenschlaeger
(74) *Attorney, Agent, or Firm* — Schneider IP Law LLC; Laura A. Schneider

(57) ABSTRACT

A child-resistant senior-friendly package and related methods are disclosed herein. A cardboard package has a container formed from a first cardboard sheet, a first wall extending between the proximal and distal ends, and a second wall opposing the first wall and extending between the proximal and distal ends, a first recess in one of the first wall or the second wall, and a first protrusion extending inwardly from the one of the first wall or the second wall, the first protrusion positioned proximal of the first recess. The cardboard package has a tray formed from a second cardboard sheet, the tray having a first resilient member in one of a first wall or a second wall, the first resilient member shaped and positioned to removably engage the first protrusion in the container, whereby the tray is maintained in a closed position.

9 Claims, 20 Drawing Sheets

(56) References Cited

U.S. PATENT DOCUMENTS

| | | | | |
|---|---|---|---|---|
| 6,491,211 | B1 * | 12/2002 | Evans | B65D 5/38 206/532 |
| 6,641,031 | B2 * | 11/2003 | Evans | B65D 5/38 206/532 |
| 7,353,969 | B2 | 4/2008 | McHutchinson | |
| 7,389,875 | B2 * | 6/2008 | Sandberg | B65D 83/0463 206/531 |
| 7,637,375 | B2 * | 12/2009 | Sattel | B65D 83/0463 206/1.5 |
| 7,708,142 | B2 * | 5/2010 | Ehrlund | B65D 5/38 206/1.5 |
| 7,854,325 | B2 * | 12/2010 | Bentele | B65D 5/38 206/1.5 |
| 8,453,840 | B2 * | 6/2013 | Wharton | B65D 11/12 206/531 |
| 9,359,123 | B2 | 6/2016 | Bhattacharjee et al. | |
| 9,475,605 | B2 * | 10/2016 | Everett | B65D 77/22 |
| 9,981,788 | B2 * | 5/2018 | Skinner | B65D 50/046 |
| 10,479,581 | B2 * | 11/2019 | Chambers | B65D 5/5035 |
| 2004/0099565 | A1 * | 5/2004 | Dehlin | B65D 50/046 206/536 |
| 2008/0217204 | A1 | 9/2008 | Sattel et al. | |
| 2008/0217205 | A1 | 9/2008 | Sattel et al. | |
| 2008/0257773 | A1 * | 10/2008 | Gelardi | B65D 83/0463 206/462 |
| 2009/0152134 | A1 * | 6/2009 | Katsis | B65D 5/38 206/96 |
| 2009/0184022 | A1 * | 7/2009 | Coe | B65D 83/0463 206/531 |

* cited by examiner

CHILD-RESISTANT SENIOR-FRIENDLY PACKAGING

CLAIM OF PRIORITY

This application claims priority to U.S. Prov. Appln. No. 62/552,801, filed on Aug. 31, 2017 and entitled "Child-Resistant Senior-friendly Packaging." This application claims priority to U.S. Prov. Appln. No. 62/595,720, filed on Dec. 7, 2017 and entitled "Child-Resistant Senior-friendly Packaging." The disclosures of both documents are incorporated herein by reference for all proper purposes.

FIELD

The present invention relates generally to child-resistant and senior-friendly packaging.

BACKGROUND

There is a need in the art for product packaging that is inexpensive, resistant to opening by children, and yet easy for seniors to use and open.

SUMMARY

An exemplary method of making a package is described. The exemplary method includes providing a first cardboard sheet and providing a second cardboard sheet. The exemplary method includes folding the first cardboard sheet into a container, the container having a proximal end, a distal end, a first wall extending between the proximal and distal ends, and a second wall opposing the first wall and extending between the proximal and distal ends. The exemplary method includes forming a first recess in one of the first wall or the second wall. The exemplary method includes forming a first protrusion on the one of the first wall or the second wall, the first protrusion extending inwardly from the one of the first wall or the second wall towards the other one of the first wall or the second wall, the first protrusion position proximal of the first recess. The exemplary method includes folding the second cardboard sheet into a tray, the tray having a first resilient member in one of a first wall or a second wall, the first resilient member shaped and positioned to removably engage the first protrusion in the container, whereby the tray is maintained in a closed position.

An exemplary cardboard package is described. The exemplary package has a container formed from a first cardboard sheet, the container having a proximal end, a distal end, a first wall extending between the proximal and distal ends, and a second wall opposing the first wall and extending between the proximal and distal ends, a first recess in one of the first wall or the second wall, and a first protrusion extending inwardly from the one of the first wall or the second wall, the first protrusion positioned proximal of the first recess. The exemplary package has a tray formed from a second cardboard sheet, the tray having a first resilient member in one of a first wall or a second wall, the first resilient member shaped and positioned to removably engage the first protrusion in the container, whereby the tray is maintained in a closed position.

An exemplary method of using a cardboard package is described. The exemplary method includes providing a cardboard package having a container and a tray, the container formed from a first cardboard sheet, the container having a proximal end, a distal end, a first wall extending between the proximal and distal ends, and a second wall opposing the first wall and extending between the proximal and distal ends, a first recess in one of the first wall or the second wall, and a first protrusion extending inwardly from the one of the first wall or the second wall, the first protrusion positioned proximal of the first recess, the tray formed from a second cardboard sheet, the tray having a first resilient member in one of a first wall or a second wall, the first resilient member shaped and positioned to removably engage the first protrusion in the container, whereby the tray is maintained in a closed position. The exemplary method includes compressing the first resilient member inwardly towards the other one of the first wall or the second wall, whereby the first resilient member is disengaged from the first protrusion.

DETAILED DESCRIPTION

Those skilled in the art will recognize that, for packaging to be considered child-resistant, regulatory guidelines require multiple points of engagement or actuation, and/or a demonstration that a child cannot open the packaging within a certain period of time. However, a challenge is to provide a child-resistant package that is also senior-friendly, which presents an opposing requirement—ease of opening, particularly for those with weakened hands or fingers and/or those with poor motor control.

The Applicants have invented a package 100 and method, as illustrated in FIGS. 1-20, that is both child-resistant (e.g. provides barriers to opening) and senior-friendly (e.g. provides ease of opening).

Figure 1:
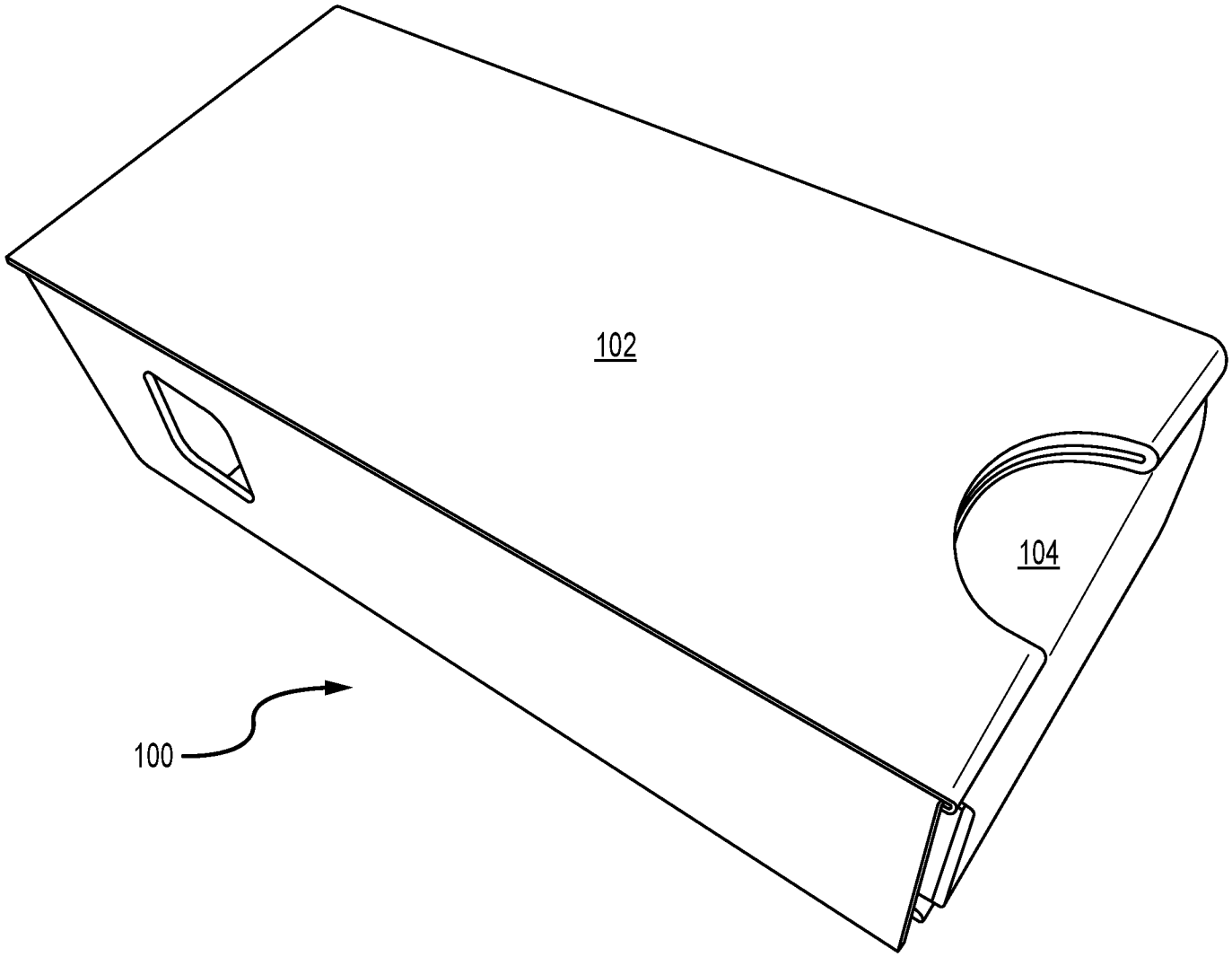
FIGS. 1-20 illustrate various views of child-resistant senior-friendly packaging and components therefore.
Figure 2:
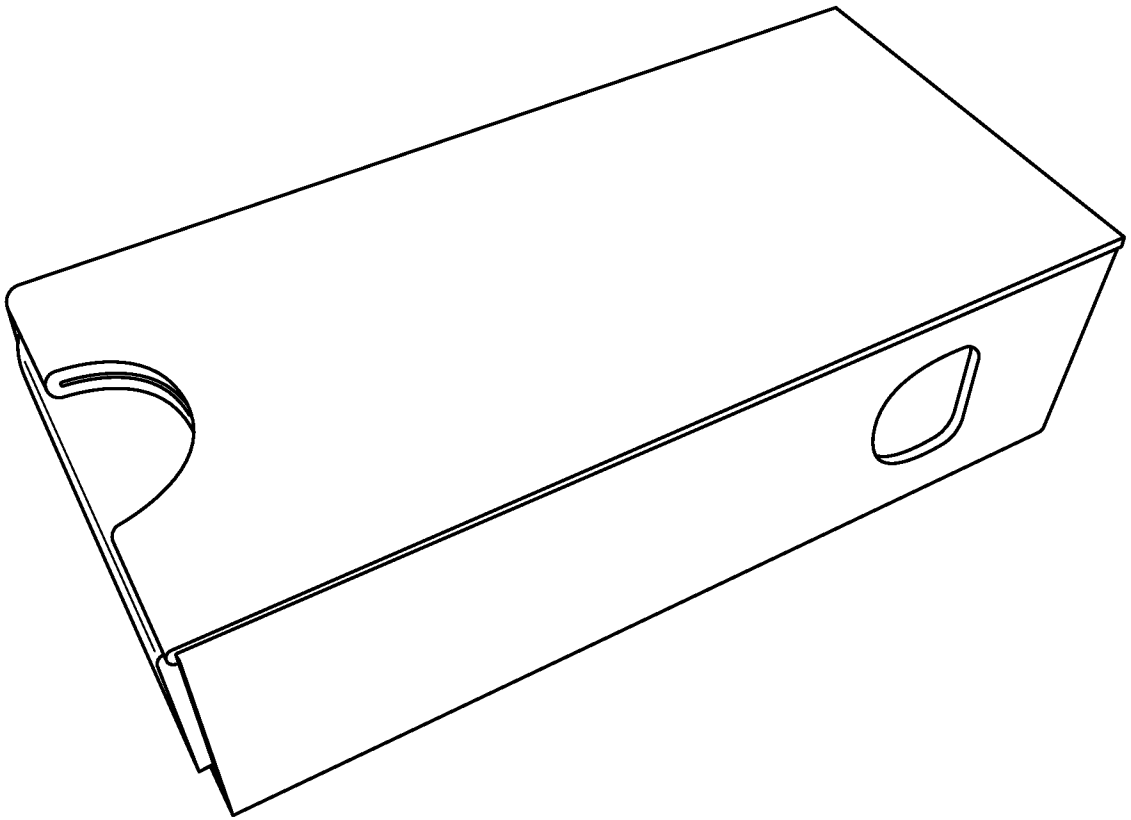
Figure 3:
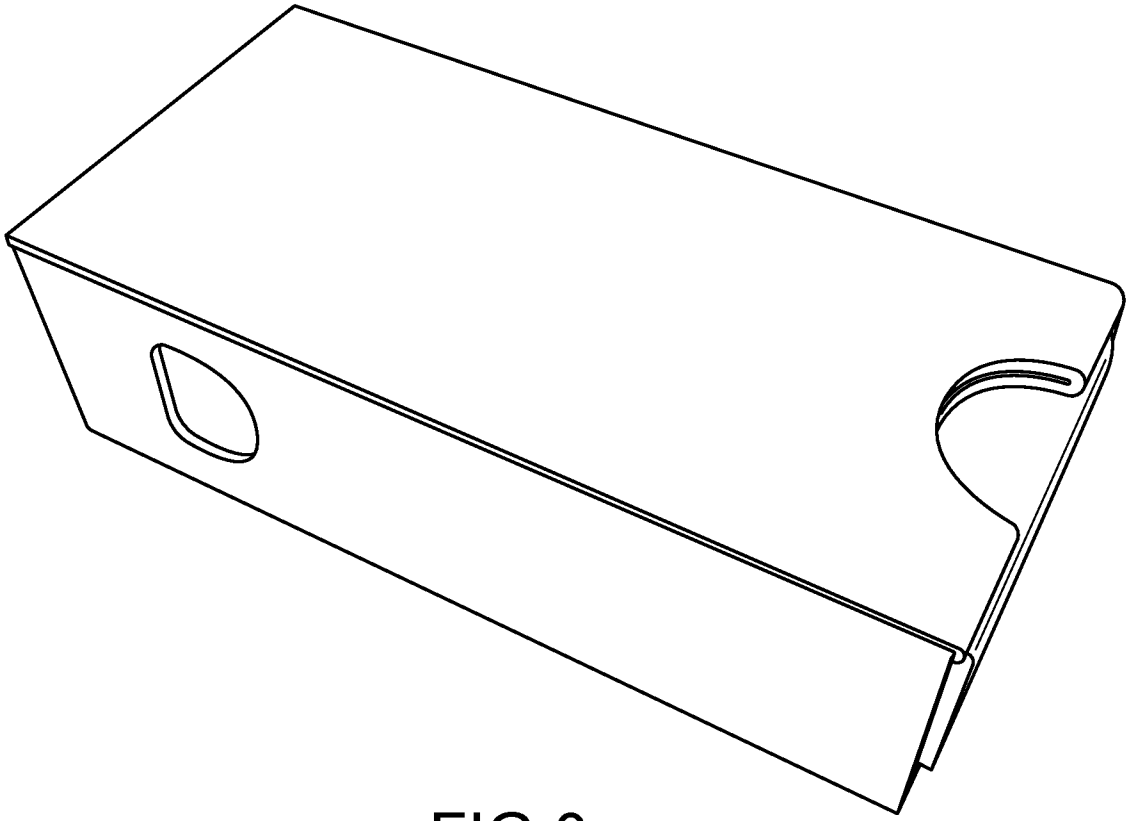
Figure 4:
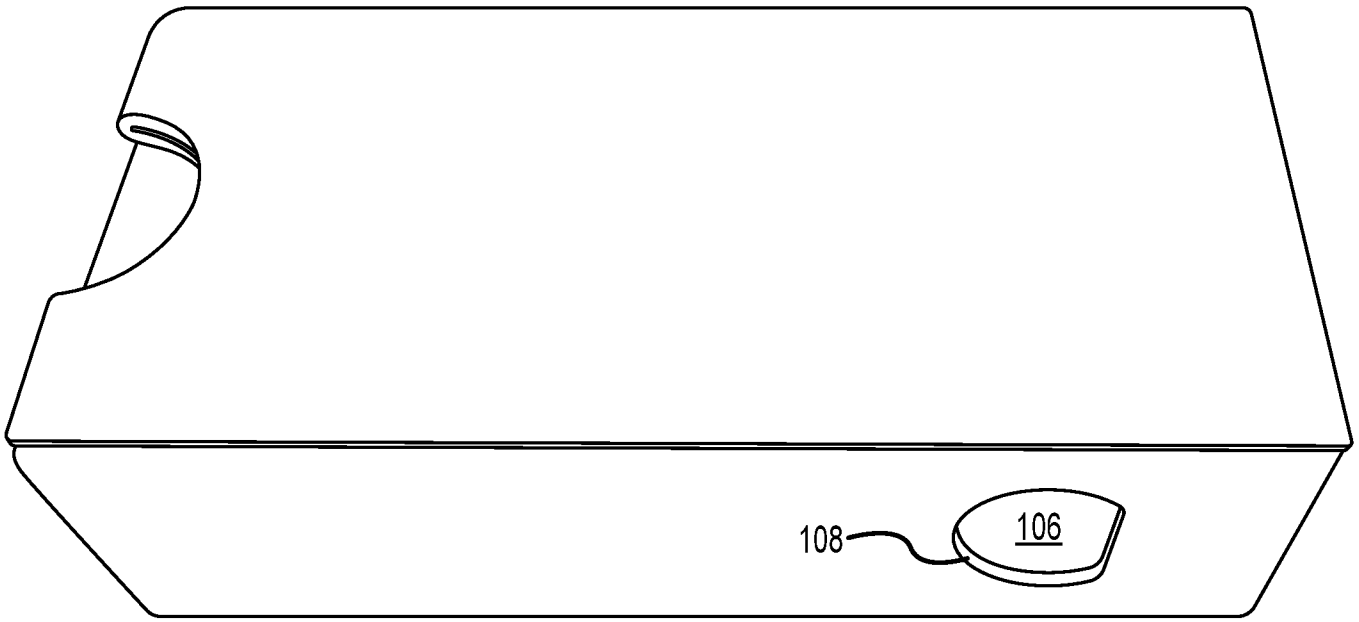
Figure 5:
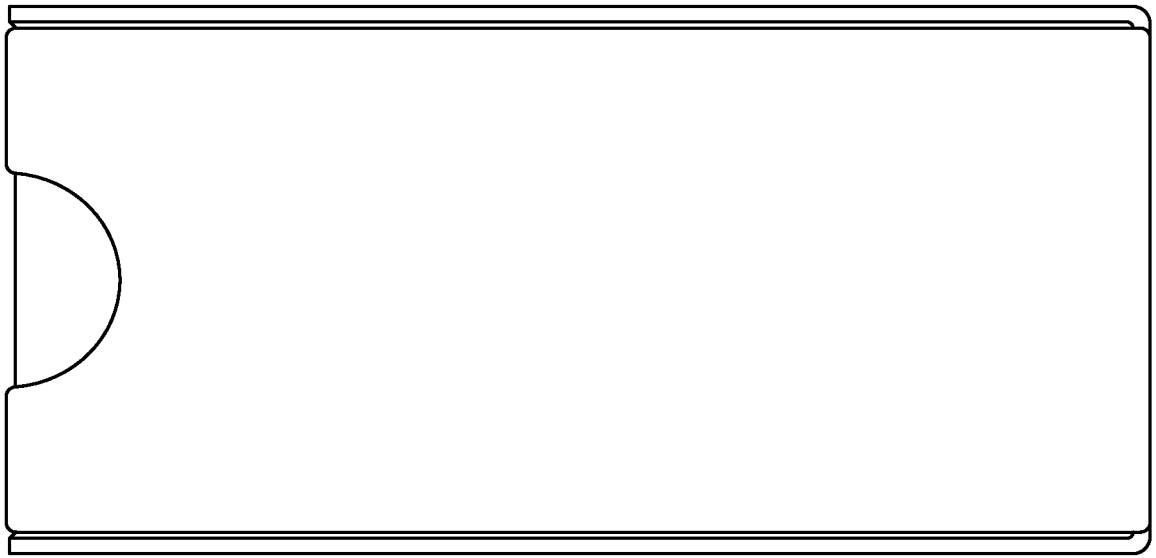
Figure 6:
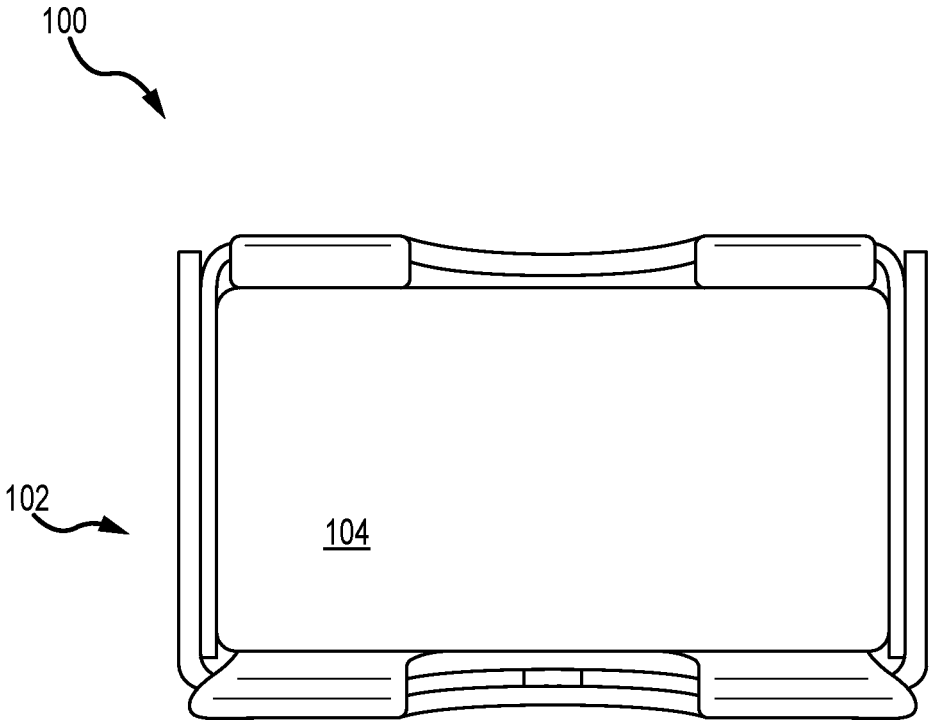
Figure 7:
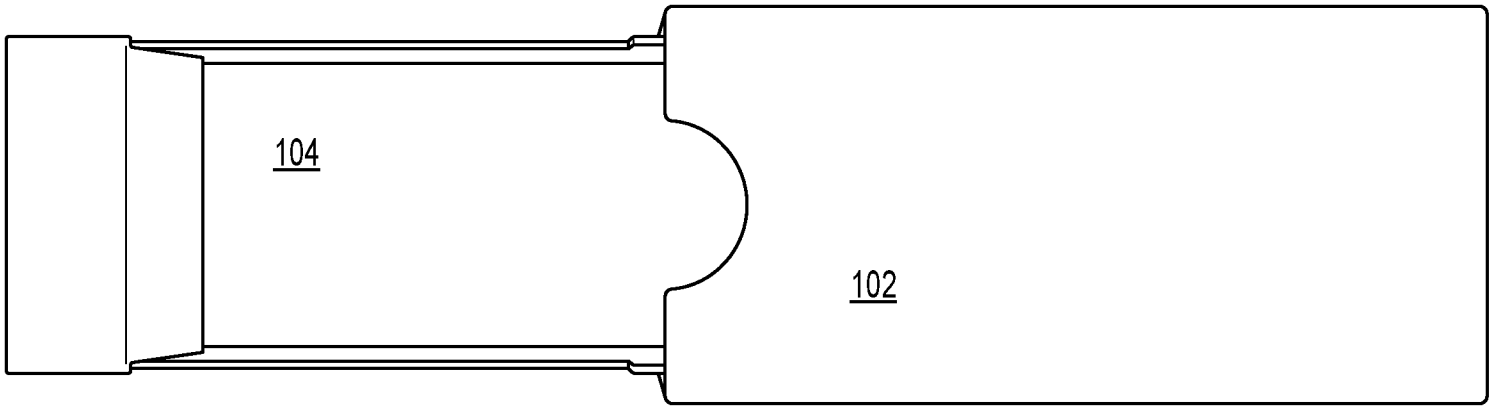
Figure 8:
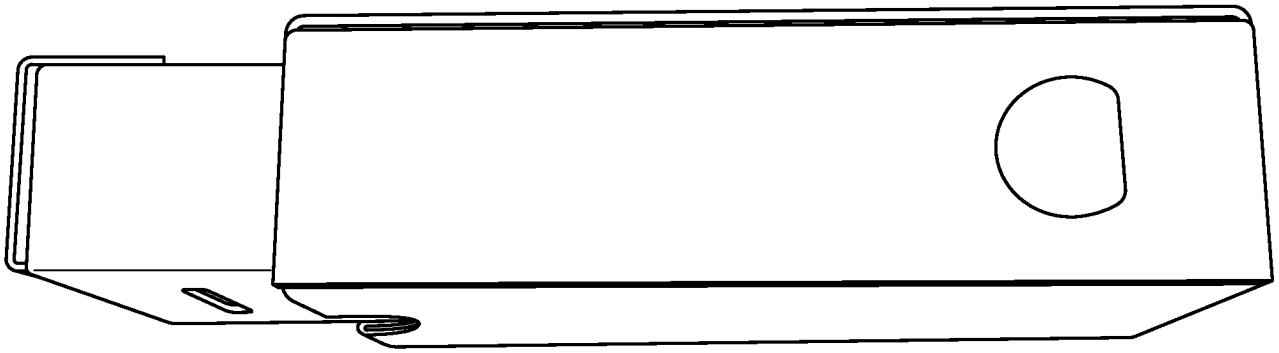
Figure 9:
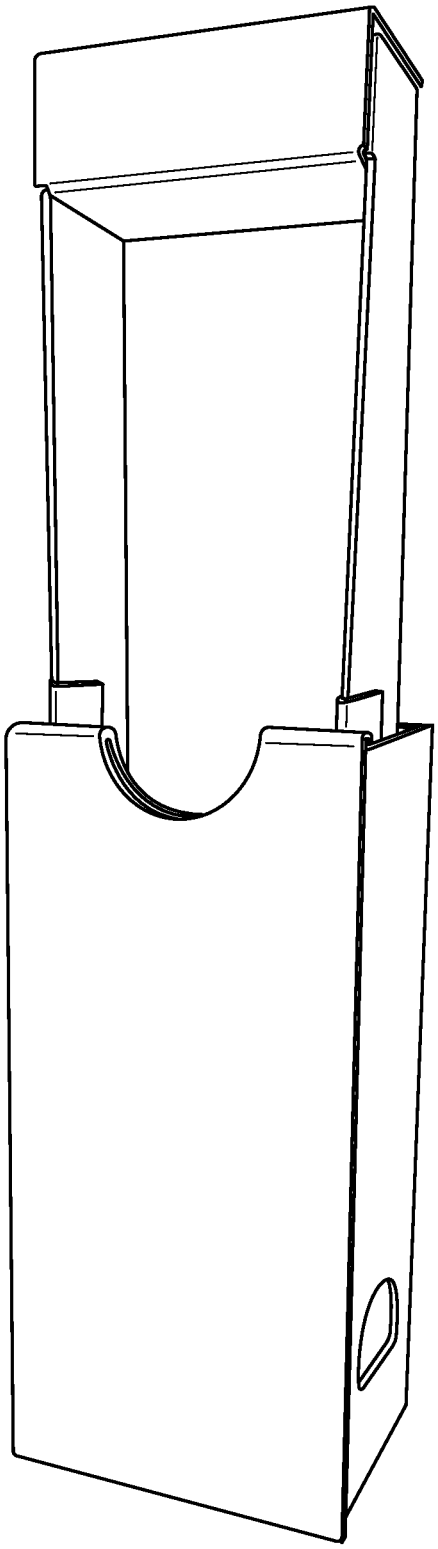
Figure 12:
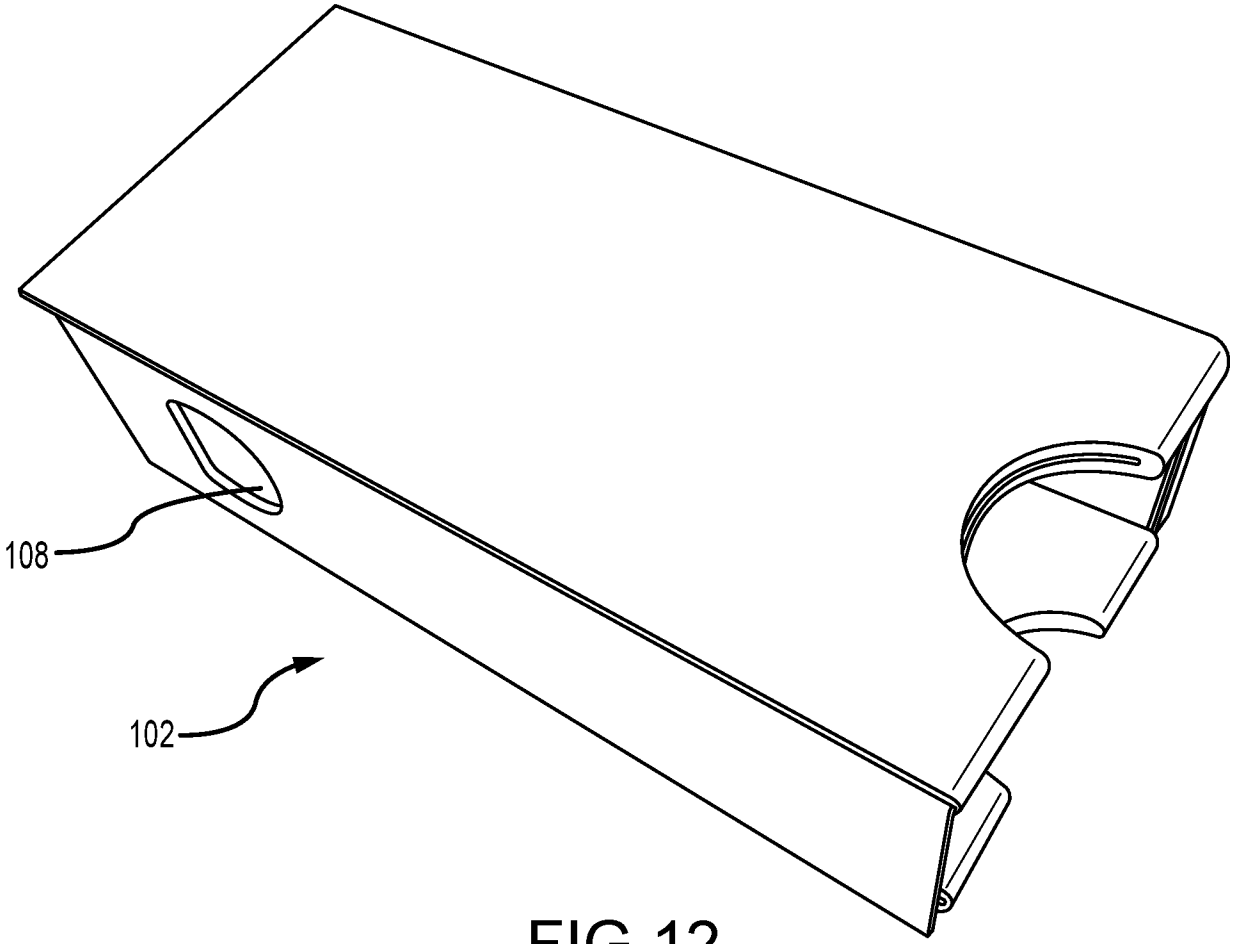
Figure 13:
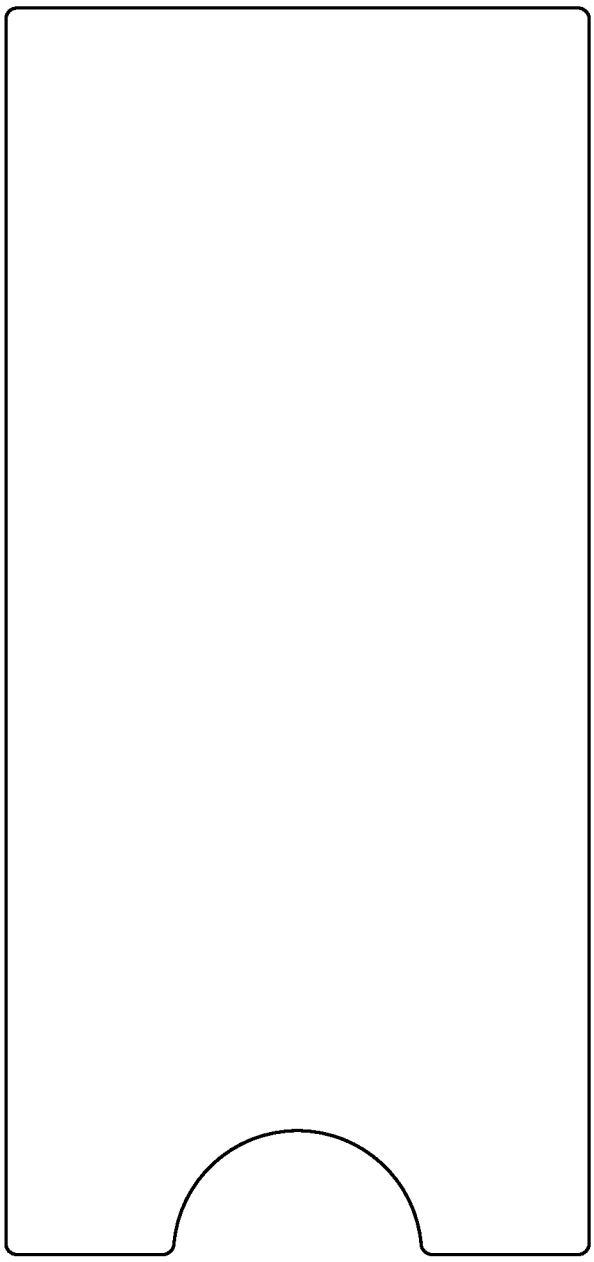
Figure 14:
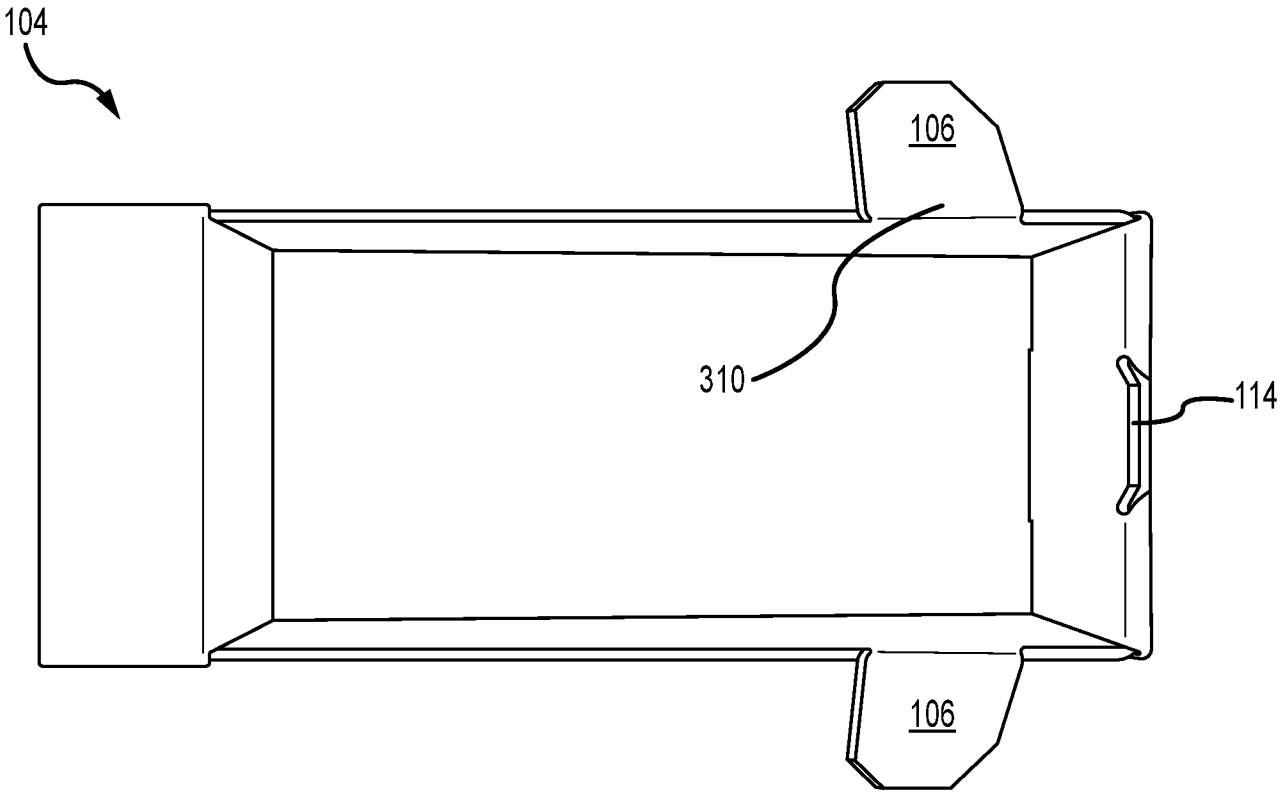

The package 100 may include a container 102 and a tray 104. The tray 104 may be slidable relative to the container 102. The tray 104 and/or the container 102 may have one or more resilient members 106 (see e.g. FIG. 14) for selectively engaging one or more recesses 108 (see e.g. FIGS. 4, 12) in the other one of the tray 104 or container 102. As illustrated in FIGS. 4, 12, and 14, the tray 104 may include a plurality of resilient members 106 for engaging a plurality of recesses 108 in the container. The resilient members 106 may be opposing resilient members 106, and may be positioned such that a user must grasp and press the resilient members 106 at the same time, to disengage the members 106 from the recesses 108, to slide the tray 104 relative to the container 102.

The container 102 and/or the tray 104 may be made of cardboard. The resilient members 106 may be made of cardboard. The entire package 100 may be made of cardboard.

Figure 10:
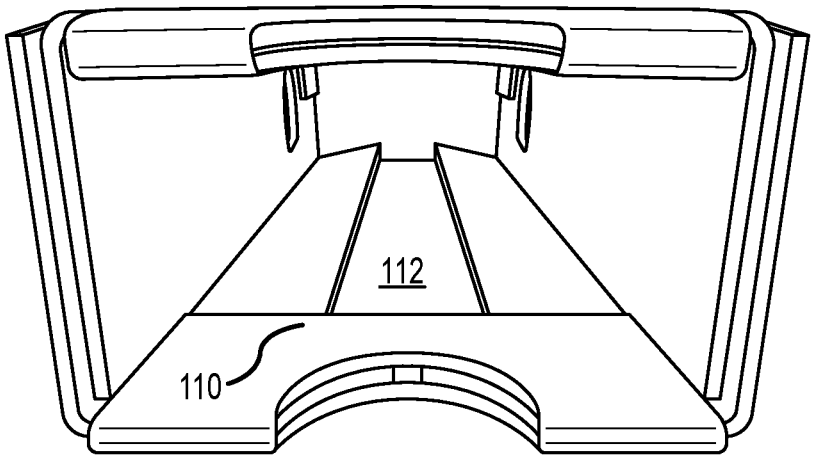
Figure 11:
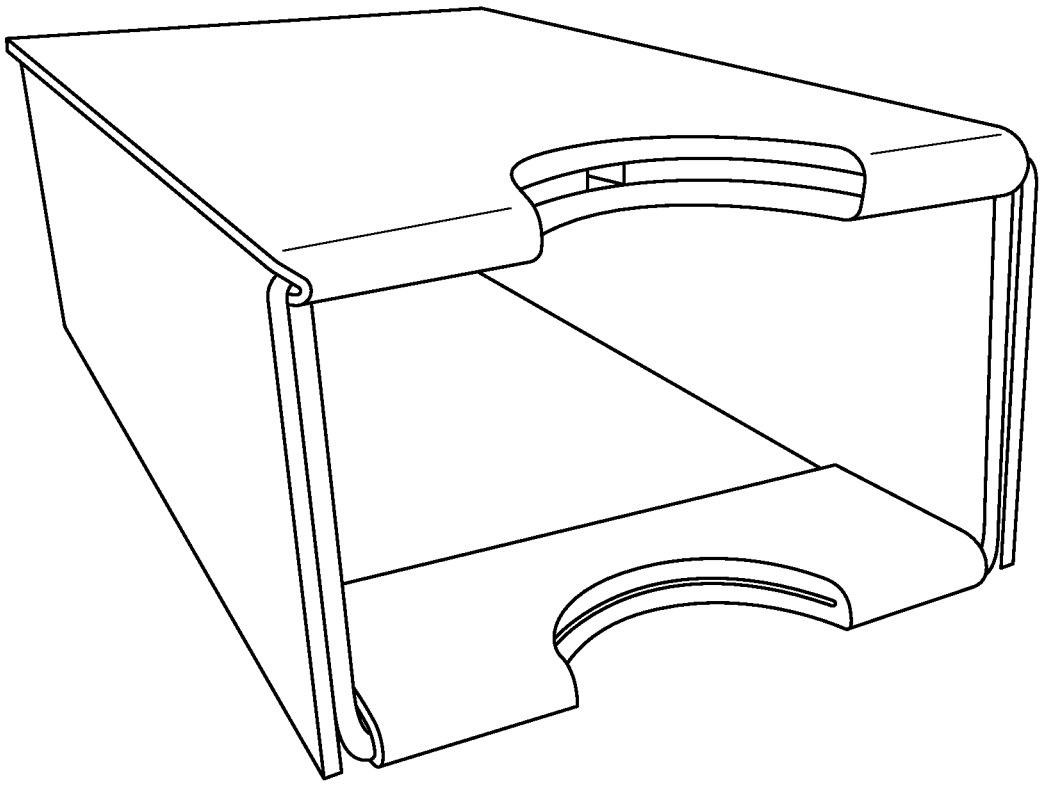

Continuing with reference to the FIGS. 10 and 14, in some embodiments, the container 102 may include a flange 110 and/or a track 112. The flange 110 may be adapted to engage a tab 114 in the tray 104 so as to prevent unintentional removal of the tray 104 from the container 102. Similarly, the track 112 may be adapted to engage a tab 114 in the tray 104 so as to limit movement of the tray 104 to substantially linear motion relative to the container 102.

Figure 15:
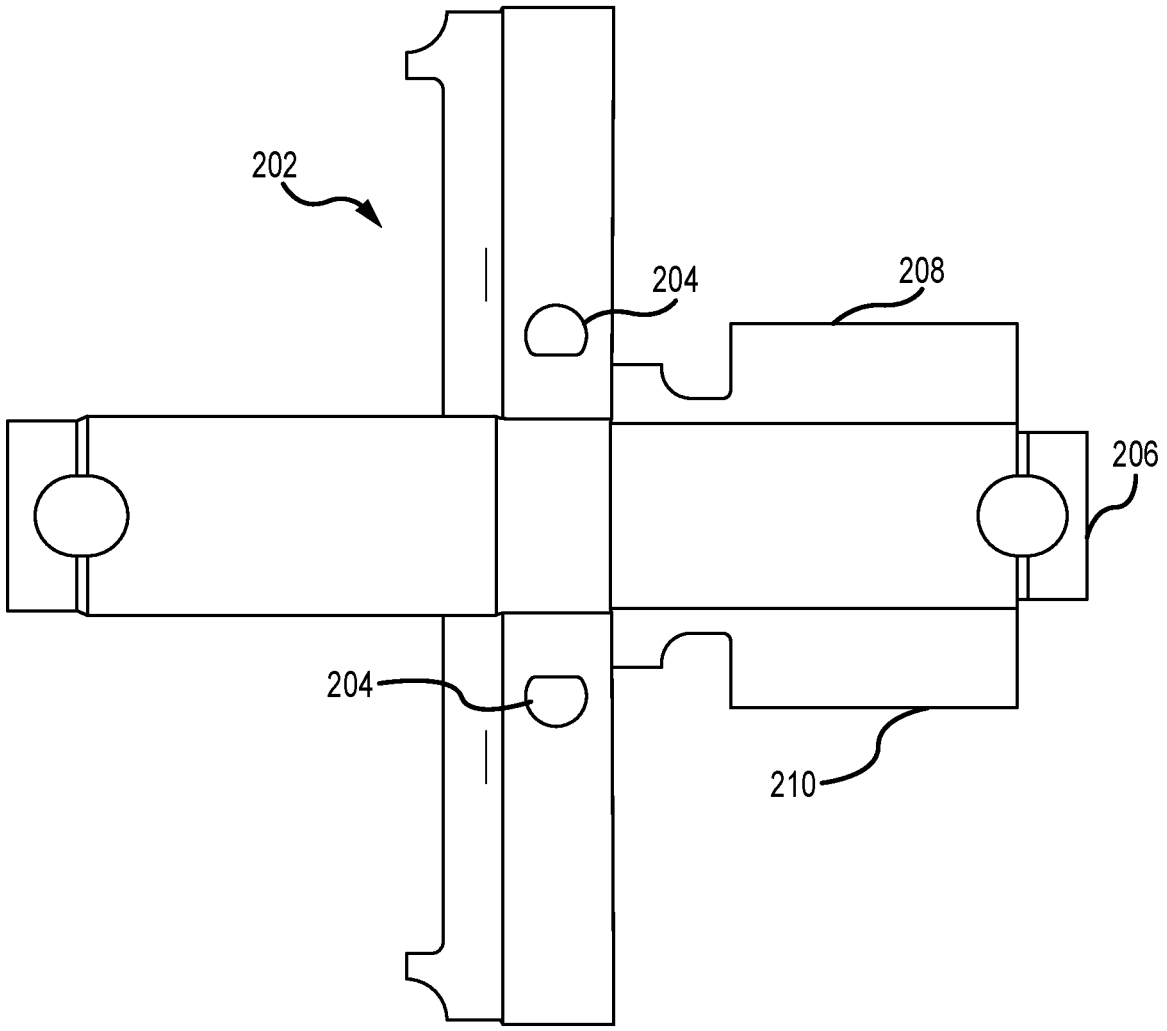

With reference now to FIG. 15, in some embodiments, a first sheet 202 may be provided to make a container, such as the container 102 illustrated in FIGS. 1-14. The first sheet 202 may be made of cardboard or another material that is formable and is adapted to at least temporarily retain a shape into which the sheet 202 is folded. The first sheet 202 may be shaped and adapted for folding into the shape of a container 102 such as that previously described herein. The first sheet 202 have a plurality of recesses 204 formed therein, the recesses 204 shaped and position to provide recesses 108 as previously described herein upon folding. The first sheet 202 may have a first tab 206 that is foldable into a position to form the flange 110 as previously described herein. The first sheet 202 may have a second tab 208 and a third tab 210 shaped and foldable into a position to form the track 112 as previously described herein.

Figure 16:
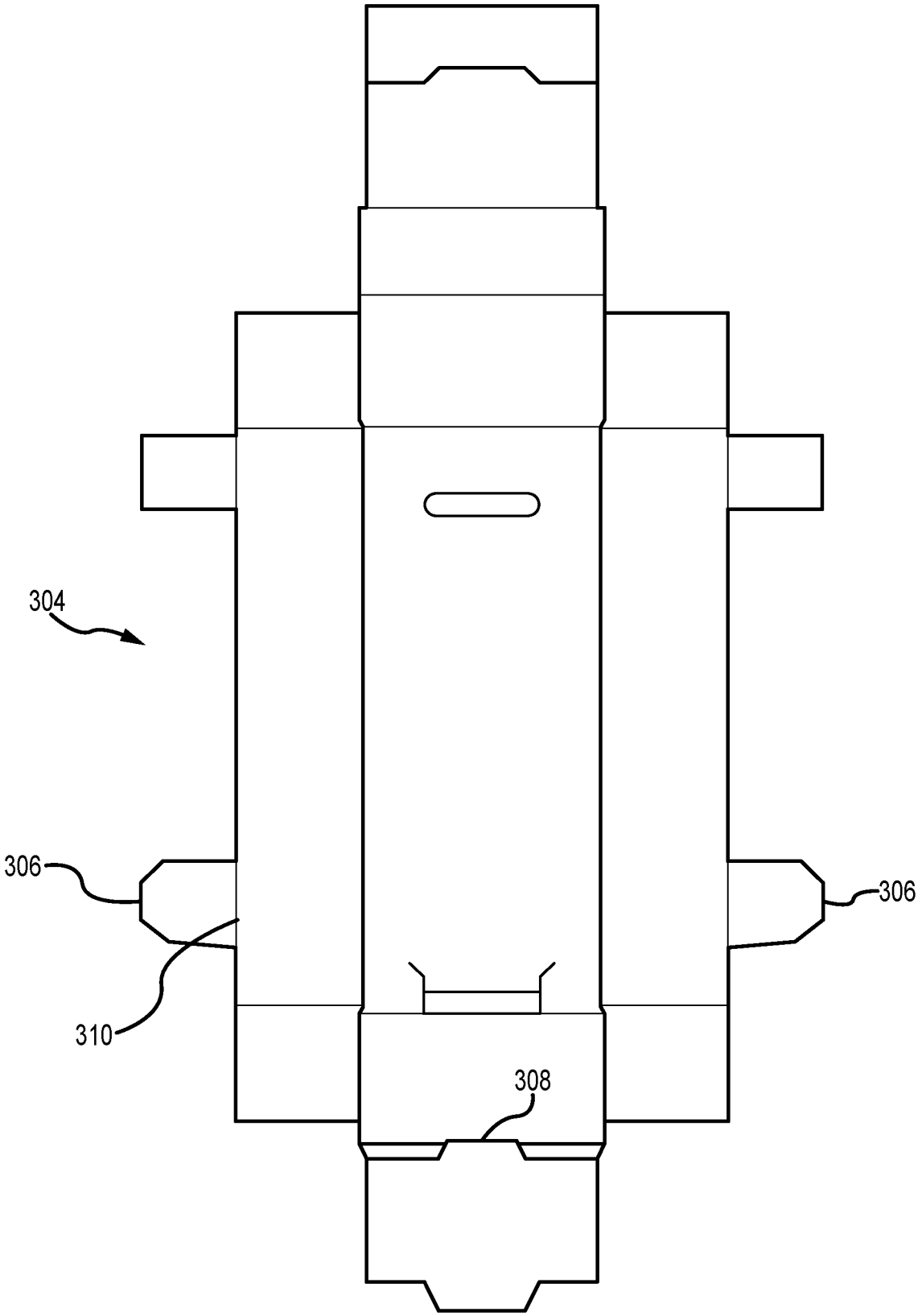

With reference now to FIG. 16, in some embodiments, a second sheet 304 may be provided to make a tray, such as the tray 104 illustrated in FIGS. 1-14. The second sheet 304 may include a first tab 308 formed therein to engage the flange 110 previously described herein. The second sheet 304 may include second and third tabs 306 shaped and positioned to form resilient members upon folding into shape. In some embodiments, at least a portion 310 of the second sheet 304 may be made of a cardboard that is at least 0.2 centimeters thick. The resilient member(s) may be formed by folding at the 0.2 centimeter thick portion. The cardboard may be corrugated. The cardboard may be double corrugated. The second and third tabs 306 may be shaped and positioned to engage the recesses 204, 108 previously described herein.

A cardboard package as described herein may include a container formed from a first cardboard sheet, the container having a proximal end, a distal end, a first wall extending between the proximal and distal ends, and a second wall opposing the first wall and extending between the proximal and distal ends, and a first recess in one of the first wall or the second wall.

Figure 18:
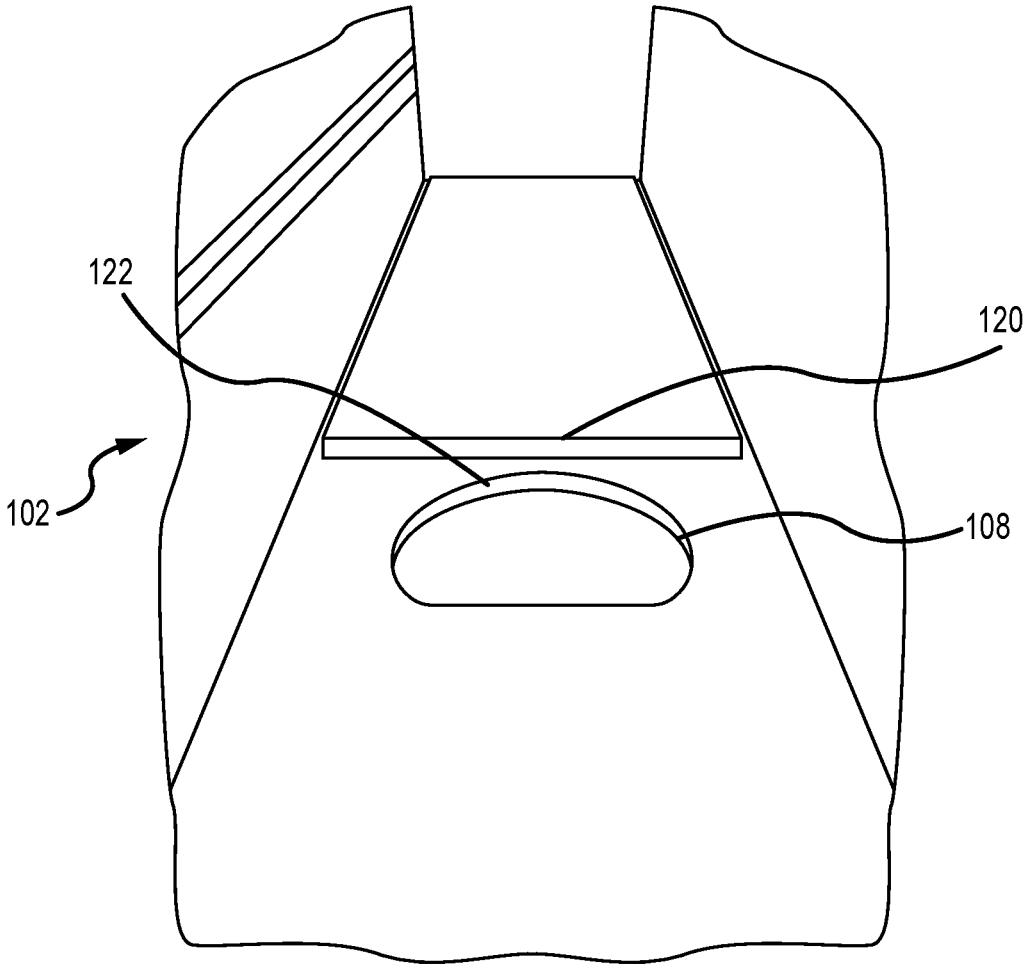
Figure 19:
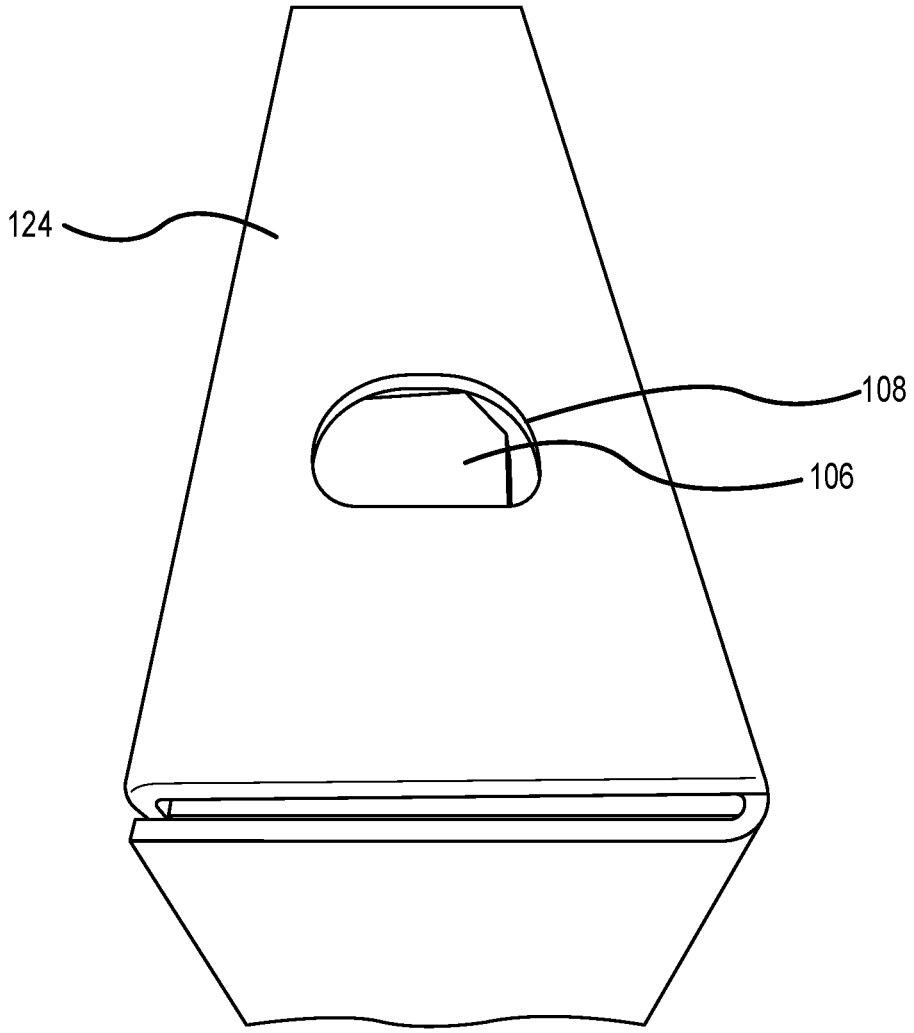

As illustrated in FIG. 18 and FIG. 19, the container may have a first protrusion 120 extending inwardly from the one of the first wall or the second wall, the first protrusion positioned proximal of the first recess 108. The first resilient member 106 may engage the protrusion 120 and/or the interior surface 122 of the wall instead of the recess 108. Those skilled in the art will recognize that configuring the package 100 in this manner prevents the resilient member 106 from extending completely through the recess 108, with the advantage that children cannot easily tear the resilient member(s) 106 off the tray. This advantage is most clearly seen in FIG. 19.

The package may have a tray formed from a second cardboard sheet, the tray having a first resilient member in one of a first wall or a second wall, the first resilient member shaped and positioned to removably engage the first protrusion in the container, whereby the tray is maintained in a closed position.

The first resilient member 106 may be disengagable from the first protrusion 120 in response to an inward force applied to the first resilient member through the first recess.

The first resilient member may be a cardboard tab folded from the second cardboard sheet.

The first protrusion may include a cardboard strip coupled to an interior surface 122 of the one of the first wall or the second wall. The cardboard strip may be folded from the cardboard sheet or may be a separate strip coupled to the interior surface 122.

The first resilient member may be shaped and positioned to engage an interior surface of the one of the first wall or the second wall when the tray is in the closed position, whereby the first resilient member does not protrude beyond an outward surface 124 of the one of the first wall or the second wall.

A cardboard package as described herein may include a container formed from a first cardboard sheet, the container having a first recess in a first wall and a second recess in a second wall opposing the first wall. The package may also have a tray formed from a second cardboard sheet, the tray having a first resilient member in a first wall and a second resilient member in a second wall opposing the first wall, the first and second resilient members shaped and positioned to removably engage the first and second recesses in the container.

The container may include a flange, and the tray may have a tab, the tab shaped and positioned to engage the flange to prevent unintentional removal of the tray from the container.

The first and second resilient members may include cardboard tabs folded from the second cardboard sheet.

The container comprises a track, and the tray may have a tab, wherein the track is shaped and positioned to engage the tab and limit motion of the tray to substantially linear motion relative to the container.

Figure 17:
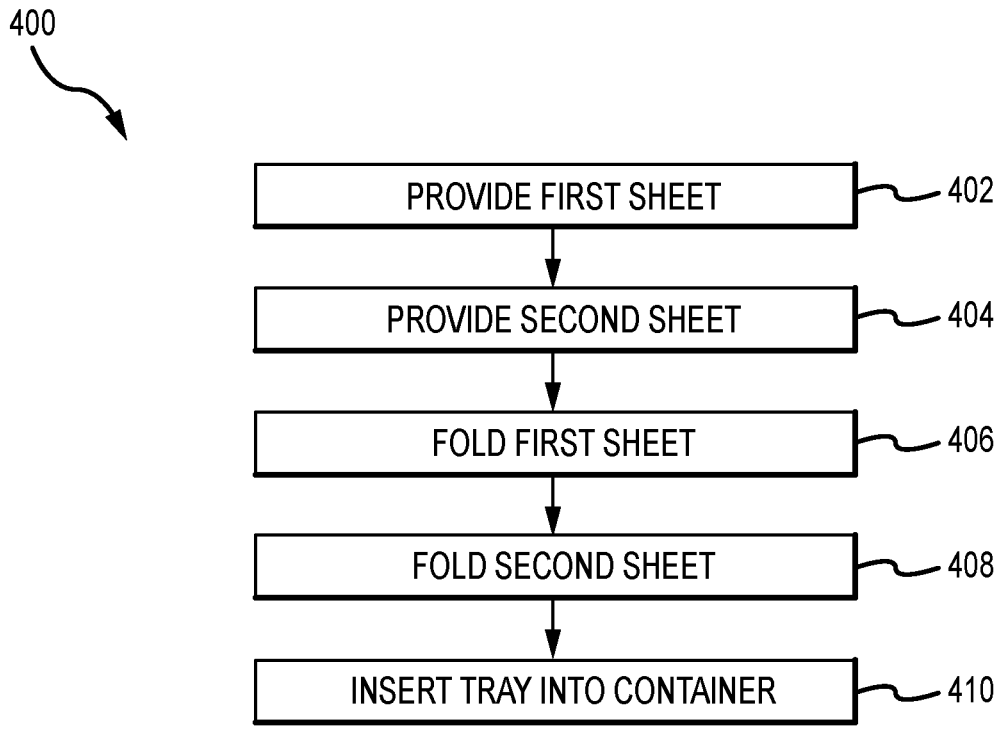

Turning now to FIG. 17, a method 400 of making a package is described. The method 400 may include providing 402 a first sheet. The first sheet may have the features of the first sheet 202 previously described herein.

The method 400 may include providing 404 a second sheet. The second sheet may have the features of the second sheet 304 previously described herein.

The method 400 may include folding 406 the first sheet into a container, such as the container 102 previously described herein.

The method 400 may include folding 408 the second sheet into a tray, such as the tray 104 previously described herein.

The method 400 may include inserting 410 the try into the container to form a child-resistant senior-friendly package, such as the package previously described herein.

A method of making a package may include providing a first cardboard sheet; providing a second cardboard sheet; folding the first cardboard sheet into a container, the container having a first recess in a first wall and a second recess in a second wall opposing the first wall; and folding the second cardboard sheet into a tray, the tray having a first resilient member in a first wall and a second resilient member in a second wall opposing the first wall, the first and second resilient members shaped and positioned to removably engage the first and second recesses in the container.

Folding the first cardboard sheet may include forming a flange. Folding the second cardboard sheet may include forming a tab, the tab shaped and positioned to engage the flange to prevent unintentional removal of the tray from the container.

The method may include sliding the tray into the container.

Folding the second cardboard sheet may include folding a plurality of tabs to form the first and second resilient members.

The method may include sliding the tray into the container and allowing the first and second resilient members to removably engage the first and second recesses.

Folding the first cardboard sheet may include forming a track. Folding the second cardboard sheet may include forming a tab; wherein the track is shaped and positioned to engage the tab and limit motion of the tray to substantially linear motion relative to the container.

Figure 20:
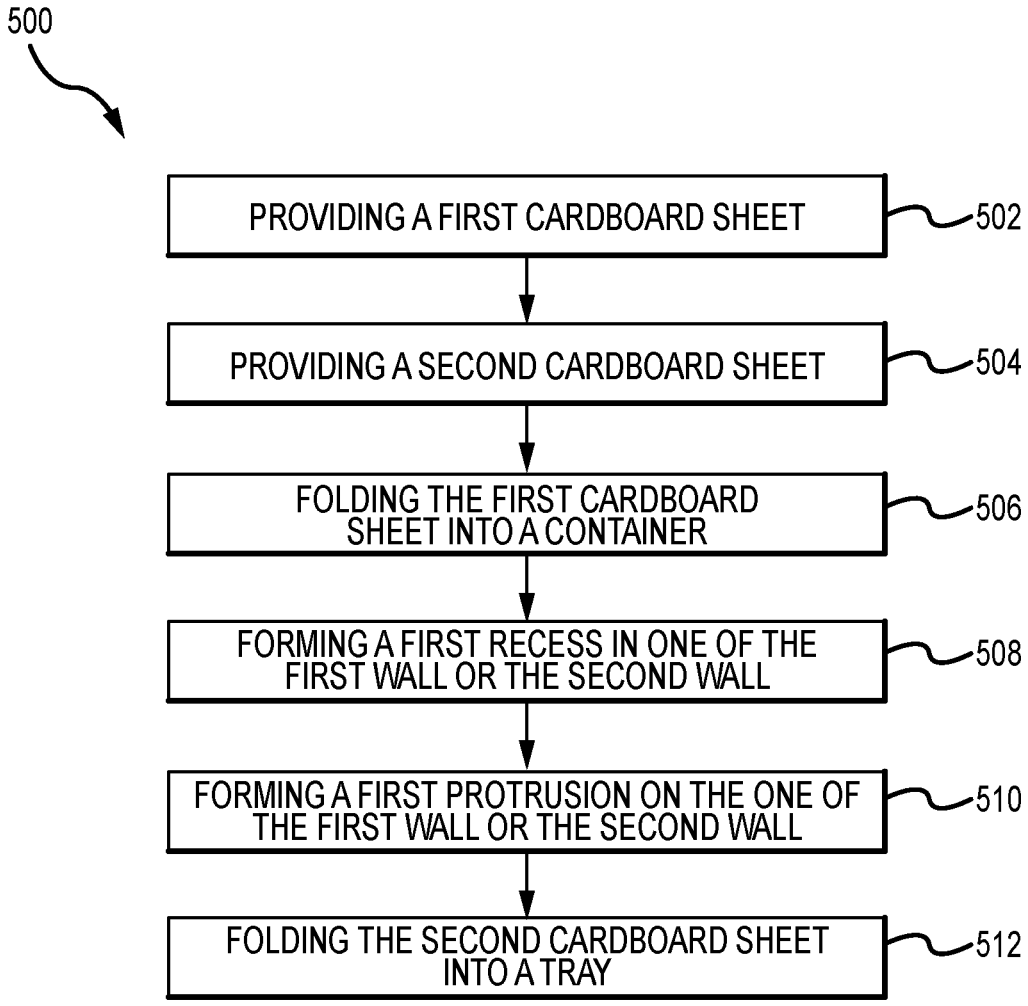

Turning now to FIG. 20, a method 500 of making a package is described. The method 500 includes providing 502 a first cardboard sheet and providing 504 a second cardboard sheet. The method 500 includes folding 506 the first cardboard sheet into a container, the container having a proximal end, a distal end, a first wall extending between the proximal and distal ends, and a second wall opposing the first wall and extending between the proximal and distal ends. The method includes forming 508 a first recess in one of the first wall or the second wall. The method 500 includes forming 510 a first protrusion on the one of the first wall or the second wall, the first protrusion extending inwardly from the one of the first wall or the second wall towards the other one of the first wall or the second wall, the first protrusion position proximal of the first recess. The method 500 includes folding 512 the second cardboard sheet into a tray, the tray having a first resilient member in one of a first wall or a second wall, the first resilient member shaped and positioned to removably engage the first protrusion in the container, whereby the tray is maintained in a closed position.

The first resilient member may be disengagable from the first protrusion in response to an inward force applied to the first resilient member through the first recess.

The method 500 may include folding the second cardboard sheet comprises folding a cardboard tab in the second cardboard sheet to form the first resilient member.

The method 500 may include folding the second cardboard sheet comprises folding a plurality of tabs to form the first resilient member and a second resilient member.

The method 500 may include sliding the tray into the container and allowing the first resilient member to removably engage the first protrusion.

The method 500 may include folding the first cardboard sheet to form a track; and folding the second cardboard sheet further to form a tab, wherein the track is shaped and positioned to engage the tab and limit motion of the tray to substantially linear motion relative to the container.

The method 500 may include coupling a cardboard strip to an interior surface of the one of the first wall or the second wall to form the first protrusion. The strip may be a folded portion of the cardboard sheet or a separate component.

The method may include shaping and positioning the first resilient member such that the first resilient member is shaped and positioned to engage an interior surface of the one of the first wall or the second wall when the tray is in the closed position, whereby the first resilient member does not protrude beyond an outward surface of the one of the first wall or the second wall.

At least a portion of the second cardboard sheet may be corrugated and have a thickness of at least 0.2 centimeters, and the method may include folding the second cardboard sheet at the portion having the thickness of at least 0.2 centimeters to form the first resilient member.

A method of using a cardboard package is disclosed herein.

A method of using a cardboard package may include providing a cardboard package having a container and a tray, and inserting a finger into a first recess in a first wall of the container; inserting a thumb into a second recess in a second wall opposing the first wall of the container. The method may also include using the finger and the thumb to compress a first resilient member in a first wall of the tray and a second resilient member in a second wall opposing the first wall of the tray. The method may also include disengaging the first and second resilient members from the first and second recesses in the container. Compressing may cause the disengaging.

The method may also include pulling the tray partially out of the container and causing a tab in the tray to engage a flange in the container to prevent unintentional removal of the tray from the container.

The first and second resilient members may include cardboard tabs folded from a cardboard sheet.

A method of using a cardboard package may include providing a cardboard package having a container and a tray, the container formed from a first cardboard sheet, the container having a proximal end, a distal end, a first wall extending between the proximal and distal ends, and a second wall opposing the first wall and extending between the proximal and distal ends, a first recess in one of the first wall or the second wall, and a first protrusion extending inwardly from the one of the first wall or the second wall, the first protrusion positioned proximal of the first recess, the tray formed from a second cardboard sheet, the tray having a first resilient member in one of a first wall or a second wall, the first resilient member shaped and positioned to removably engage the first protrusion in the container, whereby the tray is maintained in a closed position. The method may include compressing the first resilient member inwardly towards the other one of the first wall or the second wall, whereby the first resilient member is disengaged from the first protrusion.

The method of using may include pulling the tray partially out of the container and causing a tab in the tray to engage a flange in the container to prevent unintentional removal of the tray from the container.

In some embodiments, at least a portion of the second cardboard sheet is corrugated and has a thickness of at least 0.2 centimeters, and the second cardboard sheet is folded at the portion having the thickness of at least 0.2 centimeters to form the first resilient member.

The method of using may include disengaging the first resilient member from the interior surface of the one of the first wall or the second wall.

Embodiments of the invention can be embodied in a variety of ways. In addition, each of the various elements of the invention and claims may also be achieved in a variety of manners. This disclosure should be understood to encompass each such variation, be it a variation of an embodiment of any apparatus embodiment, a method or process embodiment, or even merely a variation of any element of these. Particularly, it should be understood that as the disclosure relates to elements of the invention, the words for each element may be expressed by equivalent apparatus terms or method terms—even if only the function or result is the same. As but one example, it should be understood that all action may be expressed as a means for taking that action or as an element which causes that action. Similarly, each physical element disclosed should be understood to encompass a disclosure of the action which that physical element facilitates. Regarding this last aspect, the disclosure of a "resilient member" should be understood to encompass disclosure of the act of "resilient engaging"—whether explicitly discussed or not—and, conversely, were there only disclosure of the act of "resilient engaging", such a disclosure should be understood to encompass disclosure of a "resilient mechanism". Such changes and alternative terms are to be understood to be explicitly included in the description.

In conclusion, the present invention provides, among other things, a system and method for using a child-resistant senior-friendly package. Those skilled in the art can readily recognize that numerous variations and substitutions may be made in the invention, its use and its configuration to achieve substantially the same results as achieved by the embodiments described herein. Accordingly, there is no intention to limit the invention to the disclosed exemplary forms. Many variations, modifications and alternative constructions fall within the scope and spirit of the disclosed invention as expressed in the claims.

What is claimed is:

1. A method of making a package, the method comprising:

providing a first cardboard sheet;

providing a second cardboard sheet;

folding the first cardboard sheet into a container, the container having a proximal end, a distal end, a first wall extending between the proximal and distal ends, and a second wall opposing the first wall and extending between the proximal and distal ends;

forming a first recess in one of the first wall or the second wall;

forming a first protrusion on the one of the first wall or the second wall, the first protrusion extending inwardly from the one of the first wall or the second wall towards the other one of the first wall or the second wall, the first protrusion position proximal of the first recess; and folding the second cardboard sheet into a tray, the tray having a first resilient member in one of a first wall or a second wall, the first resilient member being a tab formed out of the second cardboard sheet, the tab having at least one of a shape or a position selected such that the tab cannot extend completely through the first recess when the package is in a closed position, the tab further shaped and positioned to engage an interior surface of the one of the first wall or second wall and extend partially into the first recess, whereby the tray is maintained in the closed position.

2. The method of claim 1, wherein:

the first resilient member is disengagable from the first recess in response to an inward force applied to the first resilient member through the first recess.

3. The method of claim 1, wherein:

folding the second cardboard sheet comprises forming the first resilient member and a second resilient member, the second resilient member being a second tab.

4. The method of claim 1, further comprising:

sliding the tray into the container and allowing the first resilient member to removably engage the first recess.

5. The method of claim 1, wherein:

folding the first cardboard sheet further comprises forming a track; and folding the second cardboard sheet further comprises forming a second tab; wherein the track is shaped and positioned to engage the second tab and limit motion of the tray to substantially linear motion relative to the container.

6. The method of claim 1, wherein:

at least a portion of the second cardboard sheet is corrugated and has a thickness of at least 0.2 centimeters, the method further comprising:

folding the second cardboard sheet at the portion having the thickness of at least 0.2 centimeters to form the first resilient member.

7. A method of using a cardboard package, the method comprising:

providing a cardboard package having a container and a tray, the container formed from a first cardboard sheet, the container having a proximal end, a distal end, a first wall extending between the proximal and distal ends, and a second wall opposing the first wall and extending between the proximal and distal ends, a first recess in one of the first wall or the second wall, and a first protrusion extending inwardly from the one of the first wall or the second wall, the first protrusion positioned proximal of the first recess, the tray formed from a second cardboard sheet, the tray having a first resilient member in one of a first wall or a second wall, the first resilient member being a tab formed out of the second cardboard sheet, the tab having at least one of a shape or position selected such that the tab cannot extend completely through the first recess when the package is in a closed position, the tab further shaped and positioned to engage an interior surface of the one of the first wall or second wall and extend partially into the first recess, whereby the tray is maintained in the closed position; and compressing the first resilient member inwardly towards the other one of the first wall or the second wall, whereby the first resilient member is disengaged.

8. The method of claim 7, further comprising:

pulling the tray partially out of the container and causing a second tab in the tray to engage a flange in the container to prevent unintentional removal of the tray from the container.

9. The method of claim 7, wherein:

at least a portion of the second cardboard sheet is corrugated and has a thickness of at least 0.2 centimeters; and the second cardboard sheet is folded at the portion having the thickness of at least 0.2 centimeters to form the first resilient member.

* * * * *